United States Patent [19]

Bentley

[11] Patent Number: 4,611,142

[45] Date of Patent: Sep. 9, 1986

[54] SELF-PUMPED SPARK GAP

[75] Inventor: James H. Bentley, Huntsville, Ala.

[73] Assignee: The United States of America as represented by the Secretary of the Army, Washington, D.C.

[21] Appl. No.: 684,835

[22] Filed: Dec. 21, 1984

[51] Int. Cl.[4] ..... H01J 17/16; H01J 17/28

[52] U.S. Cl. ..... 313/30; 313/603

[58] Field of Search ..... 313/12, 13, 30, 602, 313/603, 597, 32, 35, 36, 39; 165/53, 54, 56

[56] References Cited

FOREIGN PATENT DOCUMENTS 941001 1/1974 Canada ..... 313/603

*Primary Examiner*—David K. Moore

*Assistant Examiner*—K. Wieder

*Attorney, Agent, or Firm*—Anthony T. Lane; Robert P. Gibson; Freddie M. Bush

[57] ABSTRACT

A self pumping spark gap that switches high voltage current in large amounts and provides for a flow of gas by use of one way valves. The valves open and close in accordance with changes in pressure experienced during the sparking sequence.

1 Claim, 3 Drawing Figures

SELF-PUMPED SPARK GAP

DEDICATORY CLAUSE

The invention described herein may be manufactured, used, and licensed by or for the Government for governmental purposes without the payment to me of any royalties thereon.

BACKGROUND OF THE INVENTION

Spark gaps are well known as a good way to switch high voltage current in large amounts. The ordinary spark gap uses a large flow of gas to clean the spark residue from the spark gap chamber and to cool the spark gap. This gas is typically air. This large flow of gas requires a compressor of some type. The compressor requires a power supply. The compressor and its associated plumbing present both maintenance and packaging constraints.

The object of this invention is to provide an arrangement whereby the spark gap can be made to pump itself thereby saving the costly and complexing factor of a compressed gas supply and its associated plumbing.

SUMMARY OF THE INVENTION

The device of this invention switches high voltage current in large amounts and provides for a flow of gas by use of one way valves. The valves open and close due to the changes in pressure resulting from the sparking sequence.

DESCRIPTION OF THE PREFERRED EMBODIMENT

Figure 1:
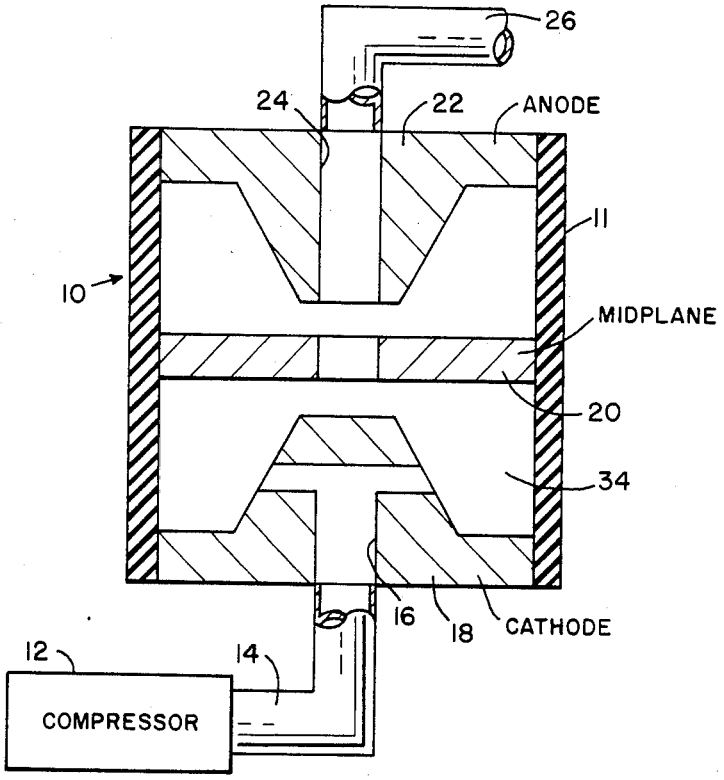
FIG. 1 is a schematic representation of a typical spark gap with a compressor and its associated plumbing.

Referring now to the drawings wherein like numerals represent like parts. FIG. 1 is a drawing of a typical prior art spark gap device 10 that includes insulating wall structure 11 with anode 22 mounted at one end and cathode 18 mounted at the other end. Compressor 12 is connected to spark gap device 10 through conduit 14 that innerconnects with passage 16 in cathode 18. An exhaust from spark gap device 10 is provided by passage 24 in anode 22 and exhaust conduit 26. Cathode 18 and anode 22 are disposed in a spaced relationship in chamber 34 so that an arc may occur between them. Spark gap device 10 may contain a midplane 20 which provides a breakdown path between the anode and cathode but existence of said midplane is not essential. The anode and cathode are made of any conventional conductive material, but most typically copper. The midplane, if one is used, is usually made of the same material as the anode and cathode.

Figure 2:
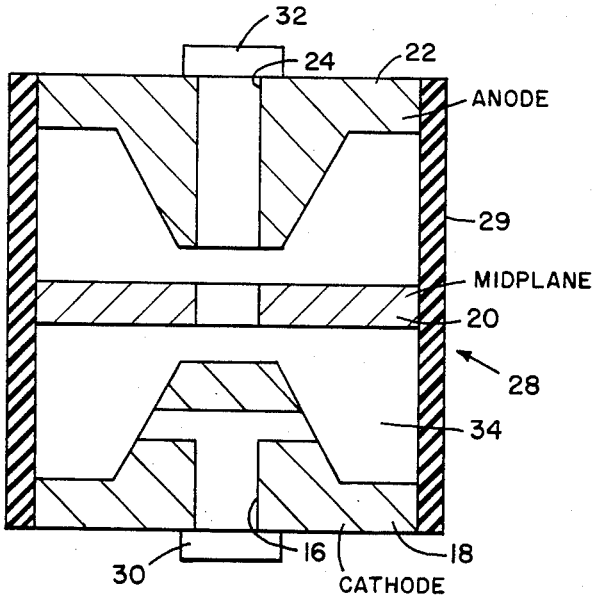
FIG. 2 is a schematic drawing of a self pumped spark gap.

FIG. 2 dipicts a self pumped spark gap device 28 of this invention. This self pumped spark gap device is defined by a housing having exterior insulated walls 29 and provided with one way inlet and outlet valves 30 and 32 respectively. Valve 30 is connected and constructed so that it opens only into the interior of the self pumped spark gap device 28 and valve 32 opens to exhaust the interior of the spark gap device. Valves 30 and 32 are identical in construction and may be spring-loaded flapper valves, reed valves or any other one way valves. The spark gap device initially contains a gas in chamber 34 at atmospheric pressure and is additionally filled with the same gas as required to maintain pressure balance in the spark gap interior. The gas in chamber 34 should be compatible with the discharge physics and should maximize heat transfer through the spark gap interior. The gas is typically air.

In operation, voltage is turned on and stand-off is achieved across the anode/cathode gap. The midplane 20 is pulsed externally causing the arc to occur. If there is no midplane, a pulse is placed between the anode and cathode. The arc causes the gases in chamber 34 to become heated and thus the closed interior of the spark gap is pressurized. Valve 32 opens under pressure and exhausts the hot gases to the outside. When the pressure reduces, valve 32 closes. As further cooling occurs a partial vacuum is formed within the now closed spark gap chamber 34. Atmospheric pressure forces valve 30 to open bringing in fresh gases which further cool the spark gap interior. As the vacuum is relieved, valve 30 closes and the operational sequence is completed.

Figure 3:
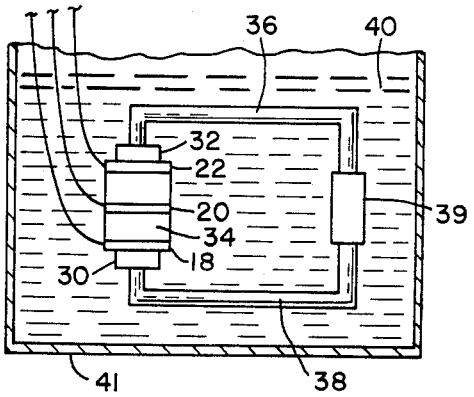
FIG. 3 is a schematic drawing of a self pumped spark gap submerged in transformer oil and connected to a heat exchanger.

FIG. 3 is a drawing of another embodiment of the self pumped spark gap device in which the spark gap is submerged in a coolant tank 41. Valves 30 and 32 are shown connected through conduit 36 and conduit 38 respectively to heat exchanger 39. The heat exchanger 39 is shown positioned in coolant 40 contained in the coolant tank 41; however, spark gap 28 can be positioned outside the coolant tank. Heat exchanger 39 can be of any design that is compatible with the conductance of the system. Conduits 36 and 38 are most typically made of copper. The coolant 40 is usually transformer oil. In operation valve 32 opens under pressure as in the other embodiment depicted in FIG. 2, and the hot gases flow through conduit 36 where cooling occurs. The gases then go through heat exchanger 39 where there is further cooling. When the pressure is relieved valve 32 closes and further cooling occurs which causes a partial vacuum within spark gap chamber 34. Valve 30 opens due to the vacuum and gases flow into the spark gap through conduit 38. As the vacuum is relieved valve 30 closes and the operational sequence is completed.

Calculations may be done to define spark generated over pressure and subsequent gas flow. It is expected that one to two percent of the energy switched by a spark gap must be dissipated by the gap in some manner. For example with a $10^3$ joule pulse 10 to 20 joules must be dissipated. If, for example, the above pulse of $10^3$ joules is placed on a spark gap with internal volume of 100 cc existing between valve 30 and valve 32 the final pressure is given by the equation $P_2=P_1(V_1/V_2)(T_2/T_1)$ In the above equation $P_1$ is the pressure at the beginning of the sparking sequence, $V_1$ is the volume of the spark gap at the beginning of the sparking sequence, $V_2$ is the volume of the spark gap at the end of the sparking sequence and is the same as $V_1$, $T_1$ is the temperature of the spark gap at the beginning of the sparking sequence, $T_2$ is the temperature of the spark gap at the end of the sparking sequence. The pressure in the spark gap at the start of the sparking sequence is atmosperic pressure. The volume of the spark gap is constant at 100 cc. The temperature within the spark gap at the start of the sparking sequence is room temperature. To calculate $T_2$ the equation $T_2-T_1=E/C_v$ is used where E is the energy dissipated in the gap and $C_v$ is the specific heat of the gas. The energy dissipated in the gap for example is 20 joules. For illustrative purposes the gas nitrogen is used which has a specific heat of 4.96 cal/mole °K. A volume of 100 cc of nitrogen at standard temperature and pressure is $4.46\times10^{-3}$ moles of nitrogen. Therefore $T_2-T_1$ is 216° K. and since $T_1$ is 300° K., $T_2$ is 516° K. Returning to our equation for $P_2$ we find that when $T_1$ is 300° K., $T_2$ is 516° K., $V_1$ and $V_2$ are 100 cc and $P_1$ is 14.7 PSIA therefore $P_2$ is equal to 25.3 PSI. The over pressure for our example is 9.8 PSI which is clearly enough to generate a gas flow to make the spark gap operational.

Although a particular embodiment and form of the invention has been described, it will be obvious to those skilled in the art that modifications may be made without departing from the scope and spirit of foregoing disclosure.

I claim:

1. A device for switching high voltage current in large amounts comprising: an insulating housing containing a chamber open at first and second ends, first and second one way valves mounted on said housing for opening and closing respective ends of said chamber, first and second electrodes disposed in said chamber in spaced relationship to form a spark gap therebetween, a third electrode between said first and second electrodes, a heat exchanger open at first and second ends, a first conduit in fluid connection with said first one way valve on one end and the first end of said heat exchanger on the other end, and a second conduit in fluid connection with the second end of said heat exchanger on one end and said second one way valve on the other end.

* * * * *